US011688595B2

(12) United States Patent
Remes et al.

(10) Patent No.: US 11,688,595 B2
(45) Date of Patent: Jun. 27, 2023

(54) OPERATING A MASS SPECTROMETER FOR SAMPLE QUANTIFICATION

(71) Applicant: Thermo Finnigan LLC, San Jose, CA (US)

(72) Inventors: Philip M. Remes, Livermore, CA (US); Michael Maccoss, Seattle, WA (US)

( * ) Notice: Subject to any disclaimer, the term of this patent is extended or adjusted under 35 U.S.C. 154(b) by 225 days.

(21) Appl. No.: 17/100,594

(22) Filed: Nov. 20, 2020

(65) Prior Publication Data

US 2022/0165556 A1 May 26, 2022

(51) Int. Cl.
*H01J 49/00* (2006.01)

(52) U.S. Cl.
CPC ..... *H01J 49/0036* (2013.01)

(58) Field of Classification Search
CPC . H01J 49/0036; H01J 49/0045; H01J 49/0031
USPC ..... 250/281, 282
See application file for complete search history.

(56) References Cited

U.S. PATENT DOCUMENTS

| | | | |
|---|---|---|---|
| 8,097,702 | B2 | 1/2012 | Cho et al. |
| 9,143,162 | B2 | 9/2015 | de Corral |
| 9,460,900 | B2 | 10/2016 | Bonner et al. |
| 9,779,929 | B2 | 10/2017 | Goshawk et al. |
| 10,170,290 | B2 | 1/2019 | Remes |
| 10,989,698 | B2 | 4/2021 | Xuan |
| 2015/0293058 | A1* | 10/2015 | Wuhr ..... G01N 27/623 250/282 |
| 2020/0286721 | A1 | 9/2020 | Meissner et al. |
| 2021/0225627 | A1 | 7/2021 | Xuan |

OTHER PUBLICATIONS

Durkalec et al. Trace Elements in the Liver of Captive and Free-ranging European Bison (*Bison bonasus* L.), Chemosphere, No. 193 2018, pp. 447-453.
Castro et al. "Determination of Quaternary Ammonium Pesticides by Liquid Chromatography—Electrospray Tandem Mass Spectrometry," Journal of Chromatography A, No. 914, 2001, pp. 111-121.
Clokie at al. "Bacteriophages: Methods and Protocols, vol. 2: Molecular and Applied Aspects", vol. 2 Humana Press, Introduction, 2008.
Klockmann et al. "Targeted Preteomics Coming of Age—SRM, PRM, and DIA Performance Evaluated from a Core Facility Perspective," Proteomics, No. 16, 2016, pp. 2183-2192.
Severin et al., "OpenSWATH enables automated, targeted analysis of data-independent acquisition MS data," Mature Biotechnology, vol. 32, No. 3, Mar. 3014, pp. 219-223.
Julaino et al., "Fase Multidimensional (3D and 4D) MS2 and MS3 Scans in a High-Transmission Pentaquadrupole Mass Spectrometer," Analytical Chemistry, vol. 68, No. 8, Apr. 15, 1996, pp. 1328-1334.

(Continued)

*Primary Examiner* — Michael Maskell

(57) ABSTRACT

Targeted quantification for mass spectrometry is described. In one aspect, a mass spectrometer can generate survey mass spectra and identify the compounds of a sample using the survey mass spectra. Compounds that elute within a same time range and do not form interfering product ions upon fragmentation can be identified, and grouped together for an MS2 scan. A series of MS2 scans can then be generated to acquire MS2 mass spectra.

17 Claims, 7 Drawing Sheets

(56) References Cited

OTHER PUBLICATIONS

Huang et al., "Synergistic Optimization of Liquid Chromatography and Mass Spectrometry parameters on Orbitrap Tribrid mass spectrometer for high efficient data-dependent proteomics," Journal of Mass Spectrometry, Apr. 15, 2020.
Li et al., "Assessing the Relationship Between Mass Window Width and Retention Time Scheduling on Protein Coverage for Data-Independent Acquisition," Journal of American Society of Mass Spectrometry, No. 30, 2019, pp. 1396-1405.

* cited by examiner

OPERATING A MASS SPECTROMETER FOR SAMPLE QUANTIFICATION

TECHNICAL FIELD

This disclosure relates to apparatus and methods for mass spectrometry, and more particularly to operation of a mass spectrometer for quantification of compounds of a sample.

BACKGROUND

A current focus of mass spectrometry is the identification, quantification, and structural elucidation of peptides, proteins, and related molecules. In such experiments, it is often necessary or desirable to perform controlled fragmentation of certain ions (referred to as tandem or MSn mass spectrometry) to yield product ions, whose mass spectra provides information that may be highly useful to confirm identification, determine quantity, or derive structural details regarding analytes of interest.

One commonly used method for MSn mass spectrometry is called data-dependent acquisition (DDA, alternatively referred to as information-dependent acquisition). The DDA technique utilizes data acquired in one mass analysis scan to select, based on predetermined criteria, one or more ion species for mass isolation and fragmentation. For example, the mass spectrometer may be configured to perform a full MS (precursor ion) scan, and then select one or more ion species from the resulting spectra for subsequent MSn analysis scans based on criteria such as intensity, charge state, mass-to-charge ratio (m/z), inclusion/exclusion lists, or isotopic patterns. The main disadvantage of the DDA methodology is the inherently random nature of the results. When technical replicates of the same sample or comparative analysis on other samples is performed, some analytes will be measured in one experiment but not in others. This frustrates attempts to perform reproducible analyses and is known as the "missing value problem".

Another method for MSn mass spectrometry is called data-independent acquisition (DIA). In DIA, all ion species within a specific m/z range are fragmented via a sequentially advancing isolation window to generate product ions. The product ions are then mass analyzed in a methodical and unbiased manner, which is much more suitable for comparing results across different samples. However, the method results in complex mass spectra that are highly multiplexed and, therefore, is a challenging scenario for data analysis.

A final method for MSn mass spectrometry is called targeted MSn (or MS/MS, MS2, MS3, etc.). This method comes in many forms and is referred to variously as selected reaction monitoring (SRM), multiple reaction monitoring (MRM) and parallel reaction monitoring (PRM). In this method, the instrument controller is instructed to perform analysis of a fixed list of compounds. Usually the introduction of the sample to the MS is performed using liquid chromatography (LC), and to increase throughput the operator schedules analysis of each compound only during a narrow period of time around the characteristic elution times of each compound. Targeted MSn is advantageous because of the high data quality that can be produced when the instrument is dedicated to the analysis of a smaller group of compounds, each with a narrow or even customized precursor isolation window. This method produces results with the best analytical figures of merit, that is, the lowest limits of detection and highest dynamic range. The disadvantage of targeted MSn is that the throughput of the analysis is more limited than in techniques like DIA, where the isolation window is usually deliberately made to be broad enough to deliberate multiplex multiple precursor ions.

SUMMARY

One innovative aspect of the subject matter described in this disclosure includes a method of operating a mass spectrometer to analyze a sample, comprising: receiving a sample; performing MS2 scans of the sample to generate survey mass spectra, the MS2 scans performed by advancing a first isolation window across a mass range of interest; identifying, using the survey mass spectra, a first compound in a first mass range within the mass range of interest and a second compound in a second mass range within the mass range of interest that elutes to the mass spectrometer within a first time range and form product ions when fragmented that do not interfere with each other within a threshold range; fragmenting, based on the identification, the first compound and the second compound isolated using a second isolation window having a mass range that at least partially includes the first mass range and the second mass range to form the product ions; acquiring a first product ion mass spectrum based on the product ions fragmented from the first compound and the second compound; and quantifying the first compound and the second compound based on the first product ion mass spectrum.

In some implementations, the method includes: identifying, using the survey mass spectrum, a third compound in a third mass range within the mass range of interest that elutes to the mass spectrometer within the first time range and forms product ions when fragmented that do interfere with the product ions of the first compound or the second compound within the threshold intensity range; fragmenting the third compound using a third mass isolation window having a range that includes the third mass range, the third mass isolation window not including the first mass range and not including the second mass range; and acquiring a second product ion mass spectrum based on the product ions fragmented from the third compound.

In some implementations, the second isolation window is wider than the third isolation window.

In some implementations, the third mass range is adjacent to the first mass range, and the first mass range is adjacent to the second mass range.

In some implementations, the first compound and the second compound are peptides.

In some implementations, the second isolation window is wider than the first isolation window.

In some implementations, the first mass range and the second mass range each correspond to different positions of the first isolation window advanced through the mass range of interest.

In some implementations, the survey mass spectra are MS2, and the first product ion mass spectrum is MS2.

Another innovative aspect of the subject matter described in this disclosure includes an apparatus including: a mass analyzer configured to receive a sample; and a controller circuit programmed with instructions to cause the mass analyzer to: perform product ion scans of the sample to generate survey mass spectra; identify, using the survey mass spectra, compounds within the sample that elute at a same time range; determine interference information of product ions that would be formed from fragmentation of the compounds that elute at the same time range; determine a schedule of product ion scans based on the compounds that elute at the same time range and the interference information; and acquire product ion mass spectra based on the schedule of product ion scans.

In some implementations, the controller circuit is further configured to: quantify the compounds based on the product ion mass spectra.

In some implementations, performing the product ion scans of the sample to generate the survey mass spectra includes positioning a first isolation window across a mass range of interest.

In some implementations, identifying the compounds within the sample that elute at the same time range includes identifying a first compound and a second compound, and determining interference information of the product ions includes determining that product ions that would be formed from the fragmentation of the first compound and the second compound do not interfere within a threshold interference range.

In some implementations, the first compound is within a first mass range, the second compound is within a second mass range, and wherein acquiring the product ion mass spectra includes fragmenting the first compound and the second compound isolated using a first isolation window having a mass range that includes at least portions of the first mass range and the second mass range to form the product ions for a first product ion mass spectrum of the product ion mass spectra.

In some implementations, identifying the compounds within the sample that elute at the same time range includes identifying a third compound, and determining interference information of the product ions includes determining that product ions that would be formed from the fragmentation of the third compound interfere with product ions of one or both of the first compound or the second compound within a threshold intensity range, and acquiring the product ion mass spectra includes fragmenting the third compound using a second isolation window having a range that is not included in a range of the first isolation window for a second product ion mass spectrum of the product ion mass spectra.

In some implementations, the first isolation window corresponds to a first scan, and the second isolation window corresponds to a second scan.

In some implementations, the compounds are peptides.

Another innovative aspect of the subject matter described in this disclosure includes a mass spectrometer configured to receive a sample, and having a controller circuit configured to: perform product ion scans of the sample to generate survey mass spectra, the product ion scans performed by advancing a first isolation window across a mass range of interest; identify, using the survey mass spectra, a first compound in a first mass range within the mass range of interest and a second compound in a second mass range within the mass range of interest that elute to the mass spectrometer within a first time range and form product ions when fragmented that do not interfere with each other within a threshold range; fragment the first compound and the second compound isolated using a second isolation window having a mass range that includes at least portions of the first mass range and the second mass range to form the product ions; and acquire a first product ion mass spectrum based on the product ions fragmented from the first compound and the second compound.

In some implementations, the controller circuit is further configured to: quantify the first compound and the second compound based on the first product ion mass spectrum.

In some implementations, the controller circuit is further configured to: identify, using the survey mass spectra, a third compound in a third mass range within the mass range of interest that elutes to the mass spectrometer within the first time range and forms product ions when fragmented that do interfere with the product ions of the first compound or the second compound within the threshold intensity range; fragment the third compound using a third mass isolation window having a range that includes the third mass range, the third mass isolation window not including the first mass range and not including the second mass range; and acquire a second product ion mass spectrum based on the product ions fragmented from the third compound.

In some implementations, the second isolation window is wider than the third isolation window.

In some implementations, the third mass range is adjacent to the first mass range, and the first mass range is adjacent to the second mass range.

In some implementations, the first compound and the second compound are peptides.

In some implementations, the second isolation window is wider than the first isolation window.

In some implementations, the first mass range and the second mass range each correspond to different positions of the first isolation window advanced through the mass range of interest.

In some implementations, the survey mass spectra are MS2, and the first product ion mass spectrum is MS2.

Another innovative aspect of the subject matter described in this disclosure includes a computer program product including one or more non-transitory computer-readable media having computer programs instructed stored therein, the computer program instructions being configured such that, when executed by one or more computing devices, the computer program instructions cause the one or more computing devices to: generate survey mass spectra indicative of compounds of a sample; identify, using the survey mass spectra, compounds within the sample that elute at a same time range; determine interference information of product ions that would be formed from fragmentation of the compounds that elute at the same time range; determine a series of product ion scans based on the compounds that elute at the same time range and the interference information; and generate product ion mass spectra based on the series of product ion scans.

Another innovative aspect of the subject matter described in this disclosure includes a computer program product including one or more non-transitory computer-readable media having computer programs instructed stored therein, the computer program instructions being configured such that, when executed by one or more computing devices, the computer program instructions cause the one or more computing devices to: predict, using a machine learning model, characteristics of a sample, the characteristics including predicted retention times and predicted MS2 mass spectra for peptides of the sample; determine a series of product ion scans to be performed on the sample based on the predicted retention times and predicted MS2 mass spectra; and generate product ion mass spectra based on the series of product ion scans.

DETAILED DESCRIPTION

Figure 1:
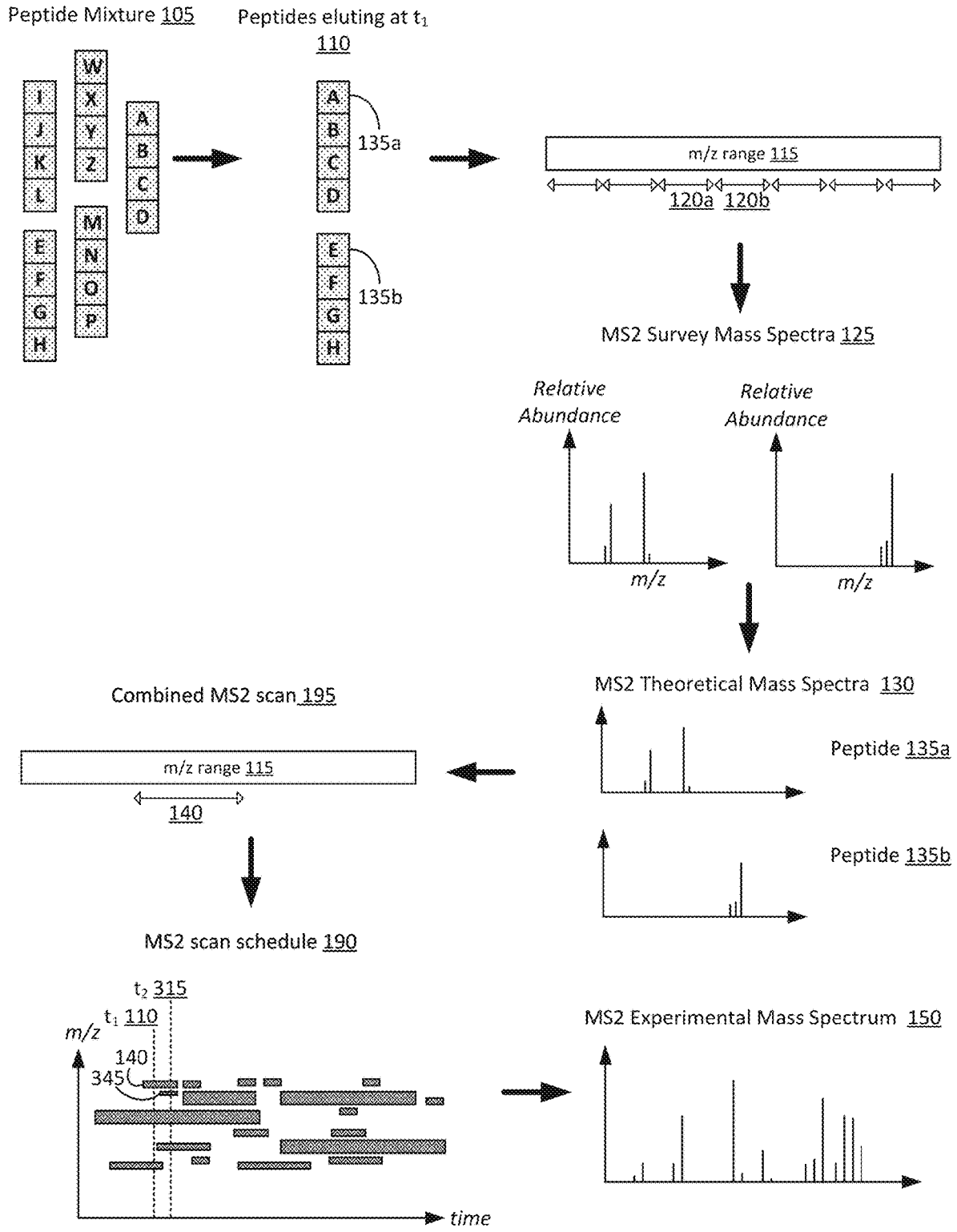
FIG. 1 illustrates an example of a mass spectrometer performing a targeted MS quantitative analysis.

Some of the material described in this disclosure includes mass spectrometers and techniques for targeted quantitative analysis. The techniques described below combine some of the best characteristics of data independent acquisition (DIA) and targeted MSn. The techniques produce multiplexed, DIA-like analysis when it is known that the fragment ions from the multiplexed ions will not interfere, and produces targeted MSn-like, high selectivity analysis when the former condition is not possible.

In one example, a mixture including peptides are introduced into a liquid chromatography (LC) system such that different peptides in the mixture are separated and introduced into a mass spectrometer for analysis at different times. The introduction period of a chromatographically separated peptide into the mass spectrometer (i.e., the time between when the peptide begins to elute from the chromatographic column and is delivered to the mass spectrometer inlet, and when elution is completed) is determined by the chromatographic peak width and defines the time available to perform mass spectrometry operations on the peptide.

The analysis can include ionization of the peptides to form precursor ions, which are subsequently fragmented to form product ions and acquire a mass spectrum (i.e., MS2 or MS/MS). The MS2 mass spectrum can be used to quantitate the peptides of the sample. As previously discussed, data-dependent acquisition (DDA), data-independent acquisition (DIA) or targeted MSn techniques can be used for quantitative analysis of the peptides of the sample. However, DDA, DIA, and targeted MSn have a variety of shortcomings.

As described later in this disclosure, a DIA-like analysis of a sample using narrow isolation width is first performed, that is, MS2 mass spectra are generated with isolation of precursors that spans a precursor m/z range. For example, MS2 mass spectra are generated with narrow isolation windows sequentially positioned, or advanced, at m/z 400, 401, 402, . . . 899, 900, 400, 401, 402, . . . , 899, 900. The compounds in the sample (e.g. peptides in the sample) that elute from the LC system at any point in time are identified based on their characteristic MS2 mass spectra. The identification of a compound, for example by matching the mass spectra against a spectral library (generated in silico or experimentally), confirms the parentage of the MS2 fragment (or product) ions. For any precursor ion that is identified at a particular time, it is possible to determine for each product ion if there is any interference in the narrow isolation window condition, and furthermore it is possible to determine if any other MS2 product ion produced in a different isolation window would produce an interference if the product ions from the two isolation windows were to be combined. If the MS2 mass spectra that are experimentally acquired indicate that no or little interference would occur among the product ions that would be formed from the co-fragmentation of the precursor ions, then MS2 of the product ions is scheduled to be performed using another, larger isolation window having a width (or non-continuous isolation windows, as described later) that includes the product ions that would fragment with no or little interference.

If a product ion would interfere, then the corresponding precursor ion is fragmented in a different isolation window. Thus, some precursor ions are grouped together for analysis with an isolation width based on the precursor ions included in the group. A schedule of MS2 scans is then generated to reflect the groupings, and experimental MS2 mass spectra are acquired based on the schedule.

By grouping, or binning, precursor ions that have little or no interference among their product ions, a lower number of MS2 scans are performed to quantitate the compounds. Additionally, any multiplexing of precursor ions is done intentionally. As a result, the throughput of the mass spectrometer (e.g., number of precursors analyzed per time) is increased relative to targeted MSn and improved quantitative analysis of the compounds is achieved relative to DIA.

Figure 2:
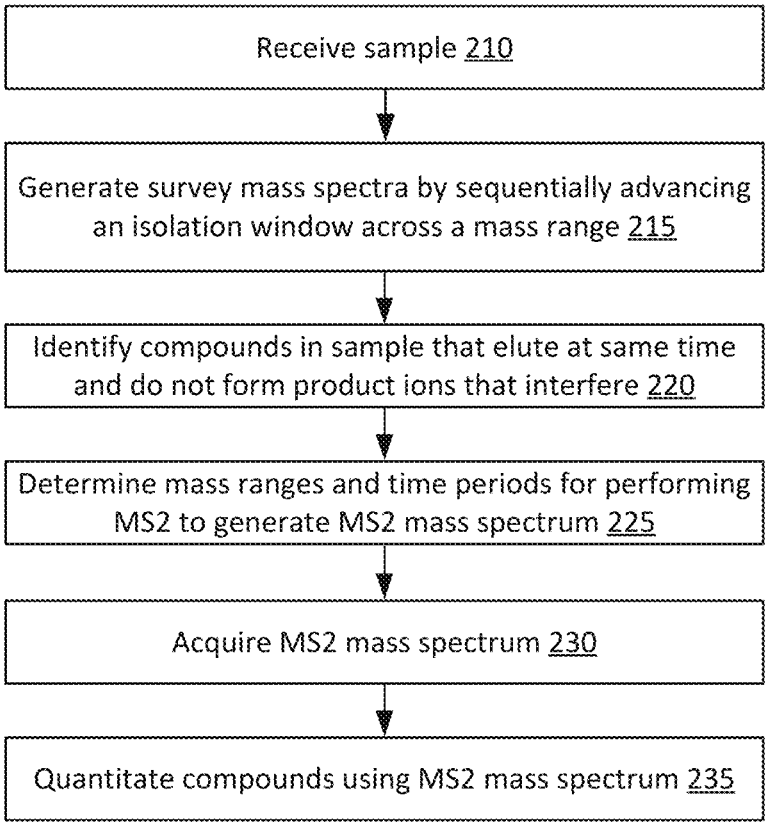
FIG. 2 illustrates an example of a block diagram for performing a targeted MS quantitative analysis.

In more detail, FIG. 1 illustrates an example of a mass spectrometer performing a targeted MS quantitative analysis. FIG. 2 illustrates an example of a block diagram for the targeted MS quantitative analysis in FIG. 1. In FIG. 2, a sample is received by a mass spectrometer (210). For example, in FIG. 1, peptide mixture 105 includes 4 peptides (labeled ABCD, EFGH, IJKL, MNOP, and WXYZ) serving as different compounds in a sample for one or both of qualitative and quantitative analysis. After being provided to a LC system for separation, different groups of peptides are provided to the mass spectrometer at different times based on peptide characteristics, including hydrophobicity. Thus, in FIG. 1, peptides 135*a* and 135*b* elute at time $t_1$ 110 while the other peptides in peptide mixture 105 might be provided to the mass spectrometer at a different time. As discussed later, the ions are ionized via an ion source and manipulated among various components of the mass spectrometer via electric fields.

Next, in FIG. 2, survey mass spectra are generated by sequentially advancing an isolation window across a mass range (215). For example, in FIG. 1, m/z range 115 is a mass range of interest in which an isolation window is sequentially advanced to different positions to filter ions of a narrower mass range within the full m/z range 115 though the isolation window can be advanced in non-sequential ways (e.g., randomly throughout the mass range, from ends of the mass range to the middle of the mass range, etc.). Thus, in FIG. 1, seven sequentially advanced isolation windows are depicted to cover the entirety of m/z range 115. Of those seven isolation windows, isolation window 120*a* might include a range of m/z values that includes the m/z of precursor ions of peptide 135*a*, and isolation window 120*b* might include a range of m/z values that includes the m/z of precursor ions of peptide 135*b*. The size or width of isolation windows 120*a* and 120*b* can be the same, or they can be different.

The precursor ions are fragmented, and the resulting product ions are detected using a detector of the mass spectrometer, electrical signals are generated in response to the detection of the product ions, and MS2 survey mass spectra 125 are acquired. MS2 survey mass spectra 125 depict the relative abundances and m/z ratios of the ions of the compounds after fragmentation (i.e., detects the product ions). That is, MS2 survey mass spectra 125 are experimental MS2 mass spectra.

Returning to FIG. 2, peptides in the sample that elute at a same time and do not form product ions that interfere with each other are then identified (220). For example, the mass spectrometer might have access to a database storing data related to theoretical MS2 mass spectra for many different peptides (e.g., based on amino acid sequences, empirically determined mass spectra (e.g. based on prior observations or experiences), or other information (e.g., charge state, inclusion/exclusion lists, or isotopic patterns)). In some implementations, the database can include data for other MSn mass spectra. Thus, in the example of FIG. 1, the peptides depicted at different m/z in MS2 survey mass spectra 125 are identified, and a MS2 theoretical mass spectrum 130 is determined for each of the identified peptides, for example, for peptides 135*a* and 135*b*. The MS2 theoretical mass spectrum of a peptide can indicate the product ions that would form upon fragmentation of the precursor ions, providing a level of confidence for the identification of the peptide.

Next, the product ions indicated in the MS2 survey mass spectra 125 are compared to determine if they interfere with each other to a threshold level or within a threshold range. For example, the mass spectrometer might first select the product ions of peptide 135*b* in FIG. 1 as a starting point for the comparison. Because peptide 135*a* is the only other identified peptide from the MS2 survey mass spectra 125, this indicates that peptide 135*a* and peptide 135*b* elute from the LC system at the same time range (e.g., within the same 10-30 second time window or time period for the base of a LC peak width).

Each of the m/z ratios of the product ions in one of the MS2 survey mass spectra 125 should be free of interference within its own corresponding isolation window. For example, the mass spectrometer can determine that the product ions shown in the MS2 survey mass spectra 125 for peptide 135*a* using isolation window 120*a* (the left-side of MS2 survey mass spectra 125) do not exhibit interferences. If the product ions within isolation window 120*a* exhibit interference, then the compound can be rejected. In one implementation, the interference can be measured in MS2 survey mass spectra 125 by identifying the time correlation of each of the product ions to the median of the product ion intensities. A rule can be implemented, for example, that at least an N number (e.g., 5) of product ions have a correlation to the median of >X (e.g., 0.95), and that the summed abundance is greater than Y (e.g., 1e3 ions/second) for a compound to be accepted for targeted analysis.

Next, each of the m/z ratios of the product ions indicated in the MS2 survey mass spectrum for peptide 135*b* are compared with the m/z ratios of each of the product ions indicated in the MS2 survey mass spectra for peptide 135*a* to determine if there is an acceptably low or no amount of interference. In a simplified example, this interference can be determined by identifying whether a ratio of abundances at a m/z is less than a threshold (e.g., 0.01). For example, the mass spectrometer can identify an intensity (of the relative abundance) of a product ion at a particular m/z for a compound in a first MS2 survey mass spectrum and compare that intensity to the intensity at the same m/z in a second MS2 survey mass spectrum. The intensities at the same m/z from the two different MS2 survey mass spectra are then compared, for example, by dividing the intensities. If the ratio is less than 0.01, then this can be considered to be acceptably low or no amount of interference. In more detail, the sum of peaks in a m/z window is performed, with the width of the m/z window dependent upon the parameters of the mass spectrometer analyzer. For example, a m/z window of +/−0.5 Da can be used for an ion trap mass analyzer, or a +/−0.05 Da m/z window can be used for an Orbitrap mass analyzer.

If the interference is below a threshold interference range or level (e.g., 1% or lower), then a later fragmentation of the peptides 135*a* and 135*b* can be performed using a single MS2 isolation window within m/z range 115 indicated as MS2 isolation window 140 of the combined MS2 scan 195 in FIG. 1, which includes the m/z values included in both isolation windows 120*a* and 120*b* (or at least parts of the two isolation windows 120*a* and 120*b*). That is, because the product ions of peptides 135*a* and 135*b* would not interfere with each other within the 1% or lower threshold interference range (or would not interfere beyond that range), MS2 can be performed using a larger isolation window that includes some or all the m/z values of isolation windows 120*a* and 120*b*. This leads to the performance of MS2 of peptides 135 and 135*b* in a multiplexed fashion because the lack of interference does not disrupt accurate acquisition of the MS2 mass spectrum. Thus, a single MS2 scan can be performed for the fragmentation of peptides 135*a* and 135*b* rather than two separate scans for each of the peptides. In another example, instead of two single Thompson (Th) scans to isolate and fragment peptides 135*a* and 135*b* separately, a single two Th scan can be performed.

In another example, the width of the isolation window that is sequentially advanced across m/z range 115 might be 1 Da and, therefore, both isolation windows 120*a* and 120*b* are both 1 Da each. The entire m/z range 115 might be 600 Da to 800 Da in a specific experiment, and the scans might be selected to have isolation window widths with boundaries that fall within regions in which ions typically do not occur. Isolation window 120*a* might include an m/z range from 628.53 to 629.53, with ions of peptide 135*a* having an m/z in this range, and the isolation window being centered at 629.036. Isolation window 120*b* might include an m/z range from 629.53 to 630.53, with ions of peptide 135*b* having an m/z in this range, and the isolation window being centered at 630.0360. As a result, MS2 isolation window 140 of combined MS2 scan 195 has a m/z range of 628.53 to 630.53. That is, the width of MS2 isolation window 140 for MS2 is the width of both of the widths of isolation windows 120*a* and 120*b*. Thus, when MS2 is later performed, a wider isolation window is used to fragment both peptides 135*a* and 135*b* because they occur within different (and neighboring) isolation windows used to generate MS2 survey mass spectra 125. However, in other implementations, the isolation windows need not be neighboring, and MS2 isolation window 140 can be non-continuous (e.g., include m/z ranges that are not adjacent to one another).

In some implementations, a targeted list of compounds might be known before the survey mass spectrum is performed. For example, an experiment might be performed to quantify known compounds in a sample that exist within a specific m/z range. However, in other implementations, the experiment might target any compound in a sample.

Returning to FIG. 2, the mass ranges and time periods for performing MS2 are used to generate a MS2 mass spectrum (225). For example, in FIG. 1, MS2 scan schedule 190 shows at time $t_1$ 110 that MS2 isolation window 140 is scheduled to be performed for the time period. Several MS2 scans can be scheduled, and the MS2 scans can have different time durations and widths of the isolation windows based on the peptides that are eluting at the same time period and the interference levels.

The schedule of MS2 scans is then acted upon by the mass spectrometer, resulting in acquiring an MS2 mass spectrum (230). For example, ions within MS2 isolation window 140 for time $t_1$ time 110 are isolated, fragmented to form product ions, and an experimental MS2 mass spectrum 150 is acquired, which would be approximately the equivalent of the MS2 theoretical spectra 130 of peptides 135*a* and 135*b* or the equivalent spectra from MS2 survey mass spectra 125. Next, in the block diagram of FIG. 2, the compounds can be quantitated using the MS2 mass spectrum (235). For example, in FIG. 1, specific product ions can be correlated with the quantification of the peptide. Additional MS2 scans are performed as indicated by MS2 scan schedule 190.

The above example describes a scenario in which a single MS2 scan is scheduled to be performed from the identification of two peptides in two separate isolation windows of the survey mass spectra (i.e., isolation windows 120*a* and 120*b* within m/z range 115). However, if both peptides were within the same isolation window used for the survey mass spectrum, for example, both within isolation window 120*a*, then MS2 isolation window 140 used for the combined MS2 scan 195 would be the same as isolation window 120*a* for the width. Additionally, if a third peptide was identified in the survey mass spectra, then another MS2 scan can be scheduled within MS2 scan schedule 190 if the third peptide would form product ions that would interfere with the product ions of one or both of the other two peptides, as described in further detail below.

Figure 3:
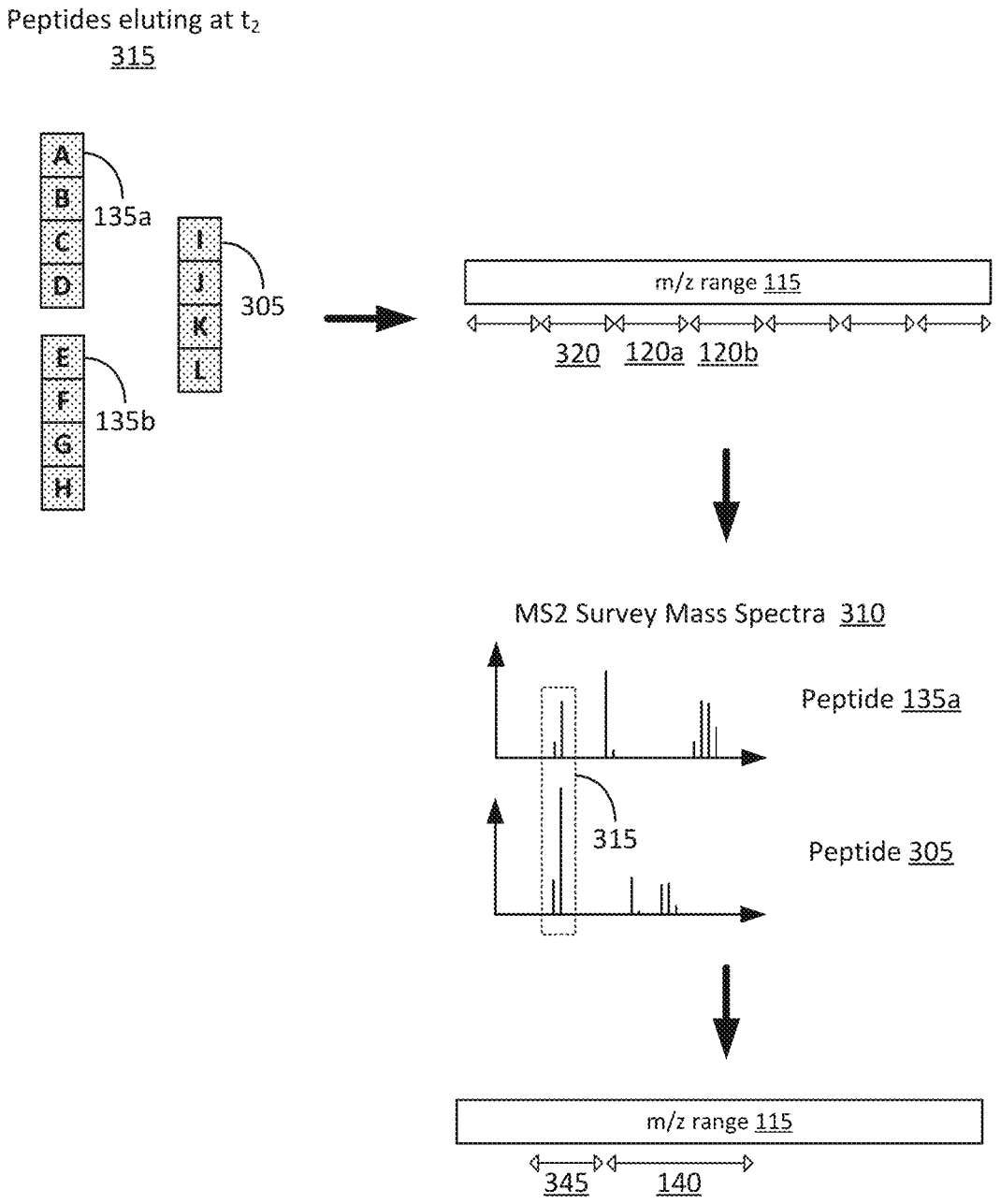
FIG. 3 illustrates another example of a mass spectrometer performing a targeted MS quantitative analysis.

FIG. 3 illustrates another example of a mass spectrometer performing a targeted MS quantitative analysis. In FIG. 3, peptides eluting at time $t_2$ 315 include a different grouping of peptides than at time $t_1$ 110. As depicted in FIG. 3, in addition to peptides 135*a* and 135*b*, peptide 305 also elutes and is provided to the mass spectrometer. The isolation window for the MS2 survey mass spectra is advanced through m/z range 115, resulting in isolation window 320 being the isolation window in which ions of peptide 305 are within, with isolation windows 120*a* and 120*b* for peptides 135*a* and 135*b*, respectively. Thus, the MS2 survey mass spectra would be similar to the MS2 mass spectra 125 in FIG. 1, except there is additional spectral information for peptide 305.

The MS2 survey mass spectra 310 can be compared with each other similar to the example described with respect to FIG. 1. However, as depicted in MS2 survey mass spectra 310 in FIG. 3, peptides 135*a* and 305 might form product ions upon fragmentation that would interfere, as indicated with interfering product ions 315. For example, one of the product ions of peptide 305 might be at the same or close m/z to a product ion of peptide 135*a*. Thus, when determining the MS2 scans, MS2 isolation window 140 in FIG. 3 might be the same as the example of FIG. 1, but MS2 isolation window 345 is a different isolation window having the width of isolation window 320. Though three peptides elute at the same time, two MS2 scans are scheduled, one being 2 Da in width, and the second being 1 Da in width if the isolation windows used for the survey mass spectrum are 1 Da in width. These two scheduled scans would require less instrumentation time than performing three scans. Additionally, because separate scans are employed for groups of precursor ions that would produce interfering product ions, the resulting MS2 mass spectra would be more accurate and of higher quality.

Returning to FIG. 1 and MS2 scan schedule 190, a MS2 scan can then be scheduled at time $t_2$ 315 for MS2 isolation window 345. MS2 isolation window 140 extends from time $t_1$ 110 to time $t_2$ 315 because peptides 135*a* and 135*b* elute during both time periods. MS2 isolation windows 140 and 345 depicted in FIG. 1 would cover adjacent m/z ranges, but a small separation is shown to facilitate visualization.

Thus, a set of MS2 survey mass spectra, are acquired using a sequentially advancing and narrow isolation window. For portions of the MS2 survey mass spectra, compounds are identified (which indicate the compounds that are present around the same time period), and interference information regarding potential product ions of the compounds are determined. A series of MS2 scans is then scheduled based on the compounds that elute from the LC system at about the same time and the interference information. At the next time period, another set of MS2 survey mass spectra are generated, and similar techniques are performed to schedule a series of MS2 scans. The MS2 scans in accordance with the schedule are then performed, and MS2 mass spectra are acquired.

Figure 7:
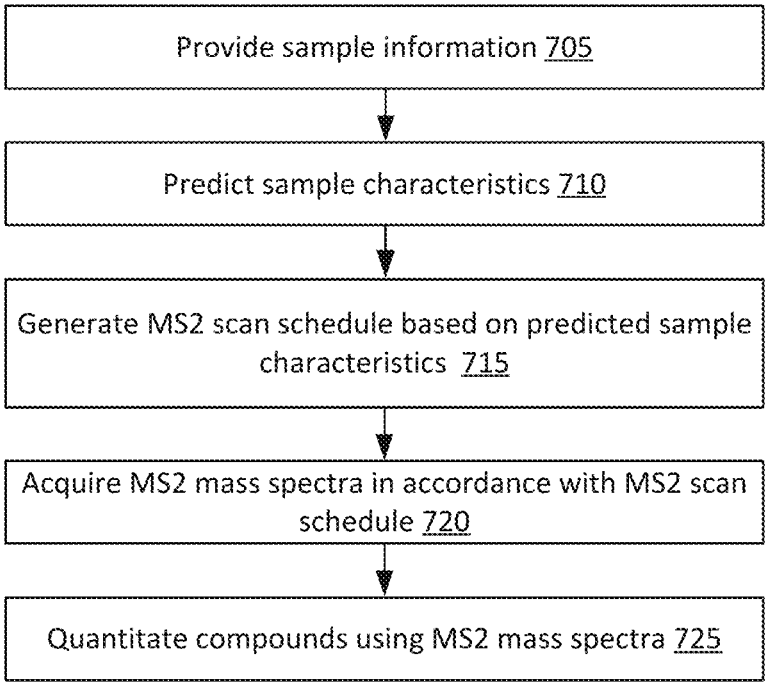
FIG. 7 illustrates another example of a block diagram for performing targeted MS quantitative analysis.

The above examples describe initially acquiring MS2 survey mass spectra, generating a MS2 scan schedule based on the MS2 survey mass spectra, and then performing subsequent MS2 scans based on the MS2 scan schedule. However, the MS2 scan schedule can also be generated based on in-silico techniques. FIG. 7 illustrates another example of a block diagram for performing targeted MS quantitative analysis. The example of FIG. 7 describes an in-silico technique.

In FIG. 7, information regarding a sample can be provided (705). For example, the compounds within the sample, their concentrations or relative abundances, hydrophobicities, hydrophilicities, hydropathicities, polarity, collision cross-sections, or how those compounds digest into peptides can be provided. In some implementations, a FASTA or peptide list can be provided.

Based on the sample information, sample characteristics can be predicted (710). For example, if information regarding the sample is known, then a machine learning model such as an artificial neural network (ANN) can be provided the sample information as an input used to predict elution times of the peptides that would be provided to the mass spectrometer, along with predicted MS2 mass spectra for each of the peptides. Moreover, how likely a peptide is observable or detectable by the mass spectrometer (a peptide's proteotypicity) can also be predicted.

If the elution time is predicted, then which peptides are introduced into the mass spectrometer at the same time can be determined if the peptides elute within the same time range. The ANN can then predict the MS2 mass spectra for each of the peptides that elute within the same time range. Interference information as described herein can then be determined in a similar way. However, instead of being based on experimental MS2 mass spectra (e.g., MS2 survey mass spectra 125 in FIG. 1), the interference information can be based on the predicted MS2 mass spectra provided by the ANN. In some implementations, the predictions for retention times and MS2 mass spectra are performed for the peptides in which the peptide is predicted to be observable or detectable. If a peptide is not observable, then the subsequent predictions are not performed.

Next, the MS2 scan schedule can be generated based on the predicted sample characteristics (715). For example, the retention times and interference information are used to generate the MS2 scan schedule. MS2 mass spectra can then be acquired in accordance to the MS2 scan schedule (720) and compounds can be quantitated using the acquired MS2 mass spectra (725).

Figure 4:
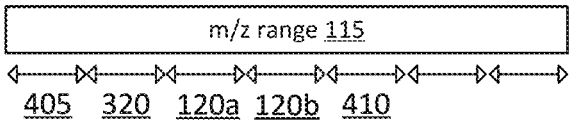
FIG. 4 illustrates an example of expanding a width of an isolation window to be used for MS2.

FIG. 4 illustrates an example of expanding a width of an isolation window to be used for MS2. In FIG. 4, the sequence of expanding the width of the isolation begins with selecting an initial isolation window used for the survey mass spectrum. In an example, isolation window 120*a* might be selected first because it includes ions from peptide 135*a*, as previously discussed. Next, one of the adjacent, or neighboring, isolation windows is checked. For example, whether isolation window 120*b* included any ions of a peptide can be identified using MS2 survey mass spectra 125 as depicted in FIGS. 1 and 3. This can be performed by finding a peak at an m/z value within the m/z range represented by isolation window 120*b*. Because precursor ions from peptide 135*b* would be within the m/z range of isolation window 120*b*, and the product ions formed from the fragmentation of peptides 135*a* and 135*b* would not interfere, a MS2 isolation window can include the range of both isolation windows 120*a* and 120*b*.

In some implementations, the first MS2 isolation window to begin the binning process has the lowest m/z range. For example, if a peptide is digested using trypsin, then most precursor ions are from 400 m/z to 900 m/z. Thus, the first isolation window would be centered near 400 m/z (e.g., 399.932 m/z if the isolation window is positioned such that its boundaries fall within regions in which ions typically do not occur). Thus, the first isolation window can be based upon empirical results.

Next, the adjacent isolation window on the other side of isolation window 120*a* is checked. As discussed with the example of FIG. 3, precursor ions of peptide 305 in isolation window 320 would form product ions upon fragmentation that would interfere with the product ions of peptide 135*a*. Therefore, the range of the isolation window used to perform MS2 on peptides 135*a* and 135 (including the range of isolation windows 120*a* and 120*b*) would not be expanded to include the m/z range of isolation window 320. Next, the isolation window adjacent to isolation window 120*b* would be checked and, if precursor ions are there, then MS2 isolation window 140 can be expanded to include the range of that adjacent isolation window. Thus, the sequence of expanding the MS2 isolation window widths can increase by first expanding to the right of the MS2 isolation window, and then checking to the left. The technique can include continuously attempting to expand the width of the MS2 isolation window by expanding until an adjacent isolation window does not include a precursor ion or includes a precursor ion that would form a product ion that would interfere, or until a predetermined or dynamically determined maximum or threshold isolation width is reached. When the MS2 isolation window reaches the adjacent isolation windows with the lowest and highest m/z values, and product ions interfere with both, then the process stops.

In other implementations, the sequence of checking other isolation windows can be different. For example, isolation windows to the right (increasing in m/z) can be checked first until stopping, and then the isolation windows to the left can be checked.

In one example experiment, the MS2 isolation window width did not increase beyond 1 Da for the majority of MS2 scans (about 55%). However, approximately 30% of the MS2 isolation window widths increased to 2 Da, while the remaining MS2 scans were in the 3, 4, or 5 Da range. Even though the majority of isolation windows for MS2 scans were still 1 Da, a significant reduction in the number of scans was achieved. For example, analysis of 7,071 compounds resulted in a significantly reduced number of scans of 1,873. This results in less instrument time needed to acquire the scans for a targeted analysis unlike using traditional MSn techniques, and generates more accurate data due to less or no interference unlike using DIA techniques. In particular, a reduction in the number of MS2 scans is achieved due to the joining of analysis of compounds in the time domain. For example, if the same isolation window includes a first peptide eluting in a first time range, and a second peptide elutes in a second time range that overlaps with the first range, then the MS2 scan schedule can be generated to have the isolation window be scheduled from the beginning of the first time range to the end of the second time range.

In some implementations, the MS2 isolation windows can be non-continuous. For example, even if isolation window 320 included precursor ions that would form interfering product ions, the next isolation window adjacent to isolation window 320 can be checked and potentially used to expand the range of MS2 isolation window 140, but not include m/z values within isolation window 345.

In the examples described above, the MS2 isolation windows for the MS2 scans using the MS2 scan schedule are multiples of the sizes of the initial MS2 isolation windows used for the survey mass spectrum. Thus, the MS2 isolation windows for the MS2 scans based on the schedule can be 1 Da, 2 Da, 3 Da, 4 Da, 5 Da, and so on if the MS2 isolation window for the survey scan that is sequentially advanced through m/z range 115 is 1 Da. Therefore, some of the MS2 isolation windows would be wider than the MS2 isolation windows for the survey scan. However, many of the MS2 isolation windows would be the same width as the survey MS2 isolation windows if adjacent isolation windows of the survey mass spectrum included interferences.

Unlike many DIA experiments, the MS2 isolation windows described above may not necessarily be centered around the m/z values of the precursor ions. Rather, as discussed above, the same or similar isolation windows used for the survey mass spectrum are used. In some implementations, once initial isolation windows are identified, further adjustment of the isolation windows can be performed based on information regarding the peptides that were included in the scans. For example, if a MS2 scan at an isolation window centered around 400 m/z has a width of 1 Da, and a single peptide at 400.3 m/z is identified within the isolation window, then the isolation window can be moved to be centered around 400.3 m/z and the width of the isolation can be reduced (e.g., to 0.5 Da).

In some implementations, a display of the mass spectrometer (or a display communicatively coupled with the mass spectrometer) might present options regarding how to perform the experiment. For example, the resources of the mass spectrometer might be analyzed, as well as the details of the experiment, and an option to perform DIA, targeted MSn, or the above-described techniques can be presented and selected to perform the experiment. Details of the experiment can include minimum dwell time, maximum isolation window width (e.g., 5 Da), number of data points for each compound per chromatogram peak, or interference threshold level. Based on the details, changes to chromatography can also be suggested, for example, increasing the length of separation or changing the slope of the chromatograph gradient.

In some implementations, operational parameters of the mass spectrometer can be adjusted to perform the experiment. For example, MS3 (i.e., fragmentation of the product ions) can be performed for a compound that does not have enough interference-free transitions in its own MS2 isolation window. While this loses the multiplexing advantages of performing MS2 on multiple compounds that do not produce interferences, additional sensitivity can be achieved for improved quantification.

Figure 5:
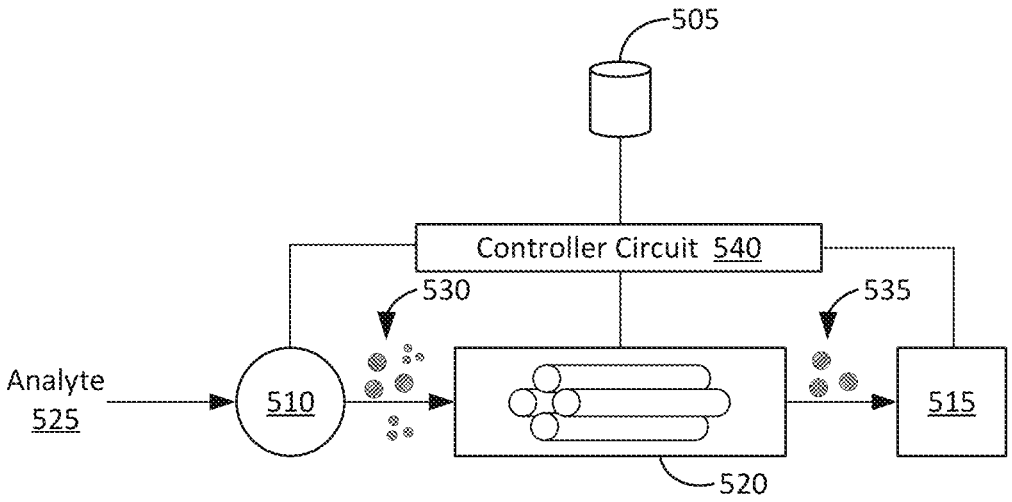
FIG. 5 illustrates an example of a mass spectrometer.

FIG. 5 illustrates an example of a mass spectrometer. In FIG. 5, a mass spectrometer includes ion source 510, tandem mass analyzer 520, detector 515, controller circuit 540, and database 505. Controller circuit 540 includes or has access to memory storing instructions to perform the techniques described in the examples and database 505 includes any information used to perform the techniques.

For example, database 505 can store a mass spectral database as described in the aforementioned examples. A mass spectral database includes an electronically-stored collection of information that includes either or both of (i) data, such as amino acid sequences for peptides and/or proteins, that may be employed to generate theoretical mass spectra based on predetermined rules (e.g., proteolysis cleavages, fragmentation predictions, etc.), or (ii) empirically derived spectra acquired previously for identified peptides (i.e., a spectral library), though other types of information related to peptides and/or proteins can also be stored. The theoretical or empirically-derived mass spectra contained in or derived from the mass spectral database includes a list of ion m/z's and optionally the corresponding measured or predicted intensities. If the experimental mass spectrum matches a candidate mass spectrum in the database, then the peptide that the experimental mass spectrum represents can be identified. Additionally, database 505 can be a storage for other types of information described herein, for example, an ANN for predicting retention times and MS2 mass spectra.

Ion source 510 receives analyte 525, for example, a peptide received from a separation device such as a liquid chromatography (LC) system and ionizes the received peptide to form ions 530. However, other types of analytes can be received and other separation techniques such as gas chromatography (GC) or capillary electrophoresis (CE) can also be used. The ions are then mass analyzed using mass analyzer 520 (e.g., a tandem mass spectrometer using combinations of quadrupoles, orbital electrostatic traps, time-of-flight, etc.). In effect, mass analyzer 520 receives ions 530 as precursor ions, isolates the precursor ions in accordance with the isolation windows discussed in the examples, fragments the isolated precursor ions to form product ions, and acquires a mass spectrum of the product ions via detector 515.

Detector 515 generates signals representative of m/z, which is interpreted by controller circuit 540 to generate or determine information that can be used to generate a mass spectrum. Controller circuit 540 can then search database 505. Based on the results, and the capabilities of the mass analyzer 520, MS2 or MS3 can be performed, as discussed in the examples above. That is, controller circuit 540 can subsequently determine how the components of mass analyzer 520 should perform and provide corresponding instructions to perform MS2 or MS3 to more accurately quantify the compounds.

The examples describe techniques for peptides, however, other biomolecules can be identified and the mass spectrometer can perform a specific action upon the identification. For example, in addition to proteins and their peptides, other types of biomolecules that can be used with the techniques include lipids, nucleic acids, metabolites, oligosaccharides, polysaccharides, and the like. Moreover, other large molecules other than biomolecules can be identified, in addition to small molecules.

The tandem mass spectrometers described in the examples can be triple quadrupole mass spectrometers (QqQ), quadrupole time-of-flight mass spectrometers (QqTOF), or other types of mass spectrometers. Additionally, while the examples describe tandem mass spectrometry in space, tandem mass spectrometry in time can also be used with the techniques described herein. In a tandem mass spectrometer in time, a single mass analyzer can be used. Moreover, more than two mass analyzers can be disposed within the mass analyzer, as also discussed with the example of FIG. 5.

The databases described in the examples are stored locally with the controller system of the mass spectrometer. However, cloud-based implementations can also be used in which the databases are stored on a remote server that is accessible by the controller. Additionally, hybrid approaches can be implemented with the techniques. For example, a smaller database stored in the system of the mass spectrometer can be searched in parallel with a larger database stored in a remote server. A hybrid approach can allow for a smaller dataset that includes higher likelihood candidate peptides to be identified relatively quickly. If the peptide under analysis is not identified with the local database, the remote database can search a larger dataset to attempt to identify a candidate peptide.

Figure 6:
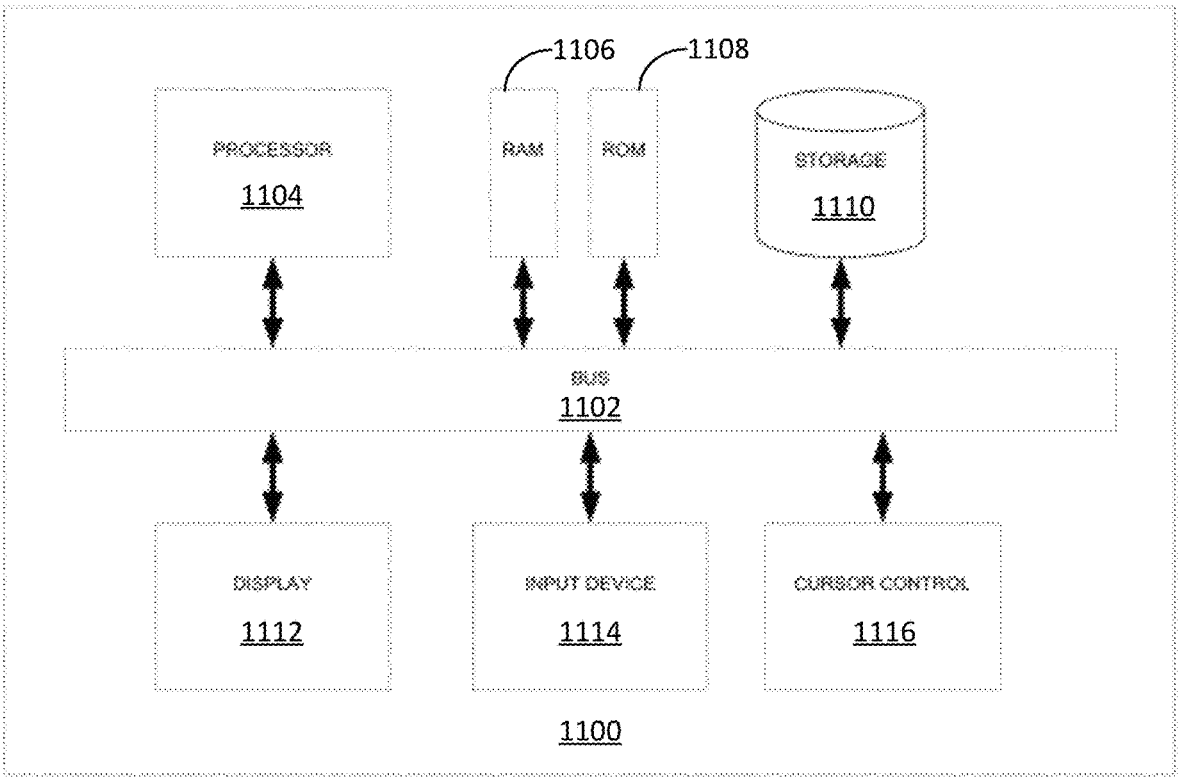
FIG. 6 illustrates an example of an electronic device which may be used to implement some of the examples.

FIG. 6 illustrates an example of an electronic device which may be used to implement some of the implementations. The electronic device of FIG. 6 can store or use a computer program product including one or more non-transitory computer-readable media having computer programs instructed stored therein, the computer program instructions being configured such that, when executed by one or more computing devices, the computer program instructions cause the one or more computing devices to implement the functionalities described in the examples.

In FIG. 6, computer system 1100 can implement any of the methods or techniques described herein. For example, computer system 1100 can implement controller circuit 540 in FIG. 5. Thus, the operation of components of the associated mass spectrometer may be adjusted in accordance with calculations or determinations made by computer system 1100. In various embodiments, computer system 1100 can include a bus 1102 or other communication mechanism for communicating information, and a processor 1104 coupled with bus 1102 for processing information. In various embodiments, computer system 1100 can also include a memory 1106, which can be a random-access memory (RAM) or other dynamic storage device, coupled to bus 1102, and instructions to be executed by processor 1104. Memory 1106 also can be used for storing temporary variables or other intermediate information during execution of instructions to be executed by processor 1104. In various embodiments, computer system 1100 can further include a read only memory (ROM) 1108 or other static storage device coupled to bus 1102 for storing static information and instructions for processor 1104. A storage device 1110, such as a magnetic disk or optical disk, can be provided and coupled to bus 1102 for storing information and instructions.

In various embodiments, computer system 1100 can be coupled via bus 1102 to a display 1112, such as a cathode ray tube (CRT) or liquid crystal display (LCD), for displaying information to a computer user. An input device 1114, including alphanumeric and other keys, can be coupled to bus 1102 for communicating information and command selections to processor 1104. Another type of user input device is a cursor control 1116, such as a mouse, a trackball or cursor direction keys for communicating direction information and command selections to processor 1104 and for controlling cursor movement on display 1112. This input device typically has two degrees of freedom in two axes, a first axis (i.e., x) and a second axis (i.e., y), that allows the device to specify positions in a plane.

A computer system 1100 can perform the techniques described herein. Consistent with certain implementations, results can be provided by computer system 1100 in response to processor 1104 executing one or more sequences of one or more instructions contained in memory 1106. Such instructions can be read into memory 1106 from another computer-readable medium, such as storage device 1110. Execution of the sequences of instructions contained in memory 1106 can cause processor 1104 to perform the processes described herein. In various embodiments, instructions in the memory can sequence the use of various combinations of logic gates available within the processor to perform the processes describe herein. Alternatively hard-wired circuitry can be used in place of or in combination with software instructions to implement the present teachings. In various embodiments, the hard-wired circuitry can include the necessary logic gates, operated in the necessary sequence to perform the processes described herein. Thus implementations described herein are not limited to any specific combination of hardware circuitry and software.

The term "computer-readable medium" as used herein refers to any media that participates in providing instructions to processor 1104 for execution. Such a medium can take many forms, including but not limited to, non-volatile media, volatile media, and transmission media. Examples of non-volatile media can include, but are not limited to, optical or magnetic disks, such as storage device 1110. Examples of volatile media can include, but are not limited to, dynamic memory, such as memory 1106. Examples of transmission media can include, but are not limited to, coaxial cables, copper wire, and fiber optics, including the wires that comprise bus 1102.

Common forms of non-transitory computer-readable media include, for example, a floppy disk, a flexible disk, hard disk, magnetic tape, or any other magnetic medium, a CD-ROM, any other optical medium, punch cards, paper tape, any other physical medium with patterns of holes, a RAM, PROM, and EPROM, a FLASH-EPROM, any other memory chip or cartridge, or any other tangible medium from which a computer can read.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

In various embodiments, the methods of the present teachings may be implemented in a software program and applications written in conventional programming languages such as C, C++, etc.

While the techniques are described in conjunction with various implementations or embodiments, it is not intended that the techniques be limited to such embodiments. On the contrary, the techniques encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

The embodiments described herein, can be practiced with other computer system configurations including hand-held devices, microprocessor systems, microprocessor-based or programmable consumer electronics, minicomputers, mainframe computers and the like. The embodiments can also be practiced in distributing computing environments where tasks are performed by remote processing devices that are linked through a network.

It should also be understood that the embodiments described herein can employ various computer-implemented operations involving data stored in computer systems. These operations are those requiring physical manipulation of physical quantities. Usually, though not necessarily, these quantities take the form of electrical or magnetic signals capable of being stored, transferred, combined, compared, and otherwise manipulated. Further, the manipulations performed are often referred to in terms, such as producing, identifying, determining, or comparing.

Any of the operations that form part of the embodiments described herein are useful machine operations. The embodiments, described herein, also relate to a device or an apparatus for performing these operations. The systems and methods described herein can be specially constructed for the required purposes or it may be a general purpose computer selectively activated or configured by a computer program stored in the computer. In particular, various general purpose machines may be used with computer programs written in accordance with the teachings herein, or it may be more convenient to construct a more specialized apparatus to perform the required operations.

Certain embodiments can also be embodied as computer readable code on a computer readable medium. The computer readable medium is any data storage device that can store data, which can thereafter be read by a computer system. Examples of the computer readable medium include hard drives, network attached storage (NAS), read-only memory, random-access memory, CD-ROMs, CD-Rs, CD-RWs, magnetic tapes, and other optical and non-optical data storage devices. The computer readable medium can also be distributed over a network coupled computer systems so that the computer readable code is stored and executed in a distributed fashion.

We claim:

1. A method of operating a mass spectrometer to analyze a sample, comprising:

receiving a sample;

performing MS2 scans of the sample to generate survey mass spectra, the MS2 scans performed by advancing a first isolation window across a mass range of interest;

identifying, using the survey mass spectra, a first compound in a first mass range within the mass range of interest and a second compound in a second mass range within the mass range of interest that elutes to the mass spectrometer within a first time range and form product ions when fragmented that do not interfere with each other within a threshold range;

fragmenting, based on the identification, the first compound and the second compound isolated using a second isolation window having a mass range that at least partially includes the first mass range and the second mass range to form the product ions;

acquiring a first product ion mass spectrum based on the product ions fragmented from the first compound and the second compound; and quantifying the first compound and the second compound based on the first product ion mass spectrum.

2. The method of claim 1, further comprising:

identifying, using the survey mass spectrum, a third compound in a third mass range within the mass range of interest that elutes to the mass spectrometer within the first time range and forms product ions when fragmented that do interfere with the product ions of the first compound or the second compound within the threshold intensity range;

fragmenting the third compound using a third mass isolation window having a range that includes the third mass range, the third mass isolation window not including the first mass range and not including the second mass range; and acquiring a second product ion mass spectrum based on the product ions fragmented from the third compound.

3. The method of claim 2, wherein the second isolation window is wider than the third isolation window.

4. The method of claim 2, wherein the third mass range is adjacent to the first mass range, and the first mass range is adjacent to the second mass range.

5. The method of claim 1, wherein the first compound and the second compound are peptides.

6. The method of claim 1, wherein the second isolation window is wider than the first isolation window.

7. The method of claim 1, wherein the first mass range and the second mass range each correspond to different positions of the first isolation window advanced through the mass range of interest.

8. The method of claim 1, wherein the survey mass spectra are MS2, and the first product ion mass spectrum is MS2.

9. A mass spectrometer configured to receive a sample, and having a controller circuit configured to:

perform product ion scans of the sample to generate survey mass spectra, the product ion scans performed by advancing a first isolation window across a mass range of interest;

identify, using the survey mass spectra, a first compound in a first mass range within the mass range of interest and a second compound in a second mass range within the mass range of interest that elute to the mass spectrometer within a first time range and form product ions when fragmented that do not interfere with each other within a threshold range;

fragment the first compound and the second compound isolated using a second isolation window having a mass range that includes at least portions of the first mass range and the second mass range to form the product ions; and acquire a first product ion mass spectrum based on the product ions fragmented from the first compound and the second compound.

10. The mass spectrometer of claim 9, wherein the controller circuit is further configured to:

quantify the first compound and the second compound based on the first product ion mass spectrum.

11. The mass spectrometer of claim 9, wherein the controller circuit is further configured to:

identify, using the survey mass spectra, a third compound in a third mass range within the mass range of interest that elutes to the mass spectrometer within the first time range and forms product ions when fragmented that do interfere with the product ions of the first compound or the second compound within the threshold intensity range;

fragment the third compound using a third mass isolation window having a range that includes the third mass range, the third mass isolation window not including the first mass range and not including the second mass range; and acquire a second product ion mass spectrum based on the product ions fragmented from the third compound.

12. The mass spectrometer of claim 11, wherein the second isolation window is wider than the third isolation window.

13. The mass spectrometer of claim 11, wherein the third mass range is adjacent to the first mass range, and the first mass range is adjacent to the second mass range.

14. The mass spectrometer of claim 9, wherein the first compound and the second compound are peptides.

15. The mass spectrometer of claim 9, wherein the second isolation window is wider than the first isolation window.

16. The mass spectrometer of claim 9, wherein the first mass range and the second mass range each correspond to different positions of the first isolation window advanced through the mass range of interest.

17. The mass spectrometer of claim 9, wherein the survey mass spectra are is MS2, and the first product ion mass spectrum is MS2.

* * * * *